United States Patent [19]

Lingnau

[11] Patent Number: 4,715,538

[45] Date of Patent: Dec. 29, 1987

[54] SWIRL JET NOZZLE AS A HYDRAULIC WORK TOOL

[75] Inventor: Horst Lingnau, Duisburg, Fed. Rep. of Germany

[73] Assignee: Woma-Apparatebau Wolfgang Maasberg & Co., GmbH, Duisburg, Fed. Rep. of Germany

[21] Appl. No.: 719,419

[22] Filed: Apr. 3, 1985

[30] Foreign Application Priority Data

Apr. 3, 1984 [DE] Fed. Rep. of Germany ..... 3412319

[51] Int. Cl.[4] ..... B05B 3/06

[52] U.S. Cl. ..... 239/248; 239/251; 239/556; 239/600; 239/DIG. 13; 134/167 C

[58] Field of Search ..... 239/DIG. 13, 246, 248, 239/249, 251, 554, 556, 560, 600, 587; 134/167 C, 168 C

[56] References Cited

U.S. PATENT DOCUMENTS

| | | | |
|---|---|---|---|
| 1,953,837 | 4/1934 | Thorold et al. | 239/246 |
| 2,790,632 | 4/1957 | Mellette | 239/587 |
| 3,120,346 | 2/1964 | Willhoite | 239/DIG. 13 |
| 3,809,317 | 5/1974 | Bender | 239/251 |
| 3,814,330 | 6/1974 | Masters | 134/167 C |

FOREIGN PATENT DOCUMENTS

| | | | |
|---|---|---|---|
| 693,235 | 8/1964 | Canada | 239/600 |
| 77562 | 4/1983 | European Pat. Off. | 239/248 |
| 2023229 | 12/1979 | United Kingdom | 239/600 |
| 371983 | 5/1973 | U.S.S.R. | 134/167 C |

*Primary Examiner*—Andres Kashnikow
*Assistant Examiner*—Michael J. Forman
*Attorney, Agent, or Firm*—Chilton, Alix & Van Kirk

[57] ABSTRACT

A swirl jet nozzle as a hydraulic work tool is to be capable of operating reliably as a structurally simple tool, with smooth outer surfaces as far as possible, requiring neither bearings nor seals, so that it is also suitable for cleaning clogged, narrow tubular parts, in particular pipes, with a high-pressure medium and for drilling holes in soft materials. This is achieved by a sleeve-shaped rotor (1), arranged directly above a tapered neck (5) of a stator (2), being provided, which is supported on the stator side on a face (7) of an extended region (8) of the stator (2), preferably via a washer (6) of plastic or the like pushed over the neck (5) of the stator (2), and is axially secured by means of at least one pin (11) engaging tangentially into a circular groove (9) in the neck (5) and borne in a cross bore (10) in the rotor (1).

9 Claims, 8 Drawing Figures

SWIRL JET NOZZLE AS A HYDRAULIC WORK TOOL

BACKGROUND OF THE INVENTION (1) Field of the Invention

The invention relates to a swirl jet nozzle which is designed for use as a hydraulic tool. More particularly, this invention is directed to enhancing the reliability and service life of tools which employ a pressurized liquid to remove material from a surface. Accordingly, the general objects of the present invention are to provide novel and improved apparatus and methods of such character.

2. DESCRIPTION OF THE PRIOR ART

Known tools which can be used in particular for the cleaning of pipes or tanks consist, for example, of an inner stator having a central bore which is connectable to a high-pressure source of water or other liquid. Such tools also include a rotor, coaxially arranged around the outside of the stator and having ports for the discharge of jets of liquid which perform the desired material cutting and/or removal function. The rotor is also driveable by the pressurized liquid.

Such known tools are complicated in structure since they require bearings and seals or bushes between the rotor and stator. Due to the complicated structure and the requirement that the rotatable connection between the rotor and stator be maintained by means of a screw connection on the stator or by means of a brake, the known tools have relatively large outer dimensions which prevents their use in, for example, the cleaning of com paratively small diameter pipes. Most importantly, previously available hydraulic tools did not establish a floating bearing of the rotor on the stator which was ope rationally reliable and thus there was a constant risk of seizure.

SUMMARY OF THE INVENTION

It is therefore an object of the invention to provide a structurally uncomplicated tool having smooth outer surfaces, to the extent possible, which is reliable. A tool in accordance with the invention requires neither bearings nor seals and is suitable for cleaning clogged, narrow tubular parts, in particular pipes, with a high-pressure liquid. The tool of the present invention may also be employed for drilling holes in soft materials, for example soft rock and earth. Examples of prior art hydraulic drilling tools may be seen from U.S. Pat. 4,440,242 and pending U.S. Application Ser. No. 594,295. Furthermore, the apparatus of the present invention is operable at very high speeds and very high pressures.

Apparatus in accordance with the present invention is characterized by a sleeve-shaped rotor, which is arranged directly above a reduced diameter neck portion of a stator. The rotor is sized, shaped and positioned such that a portion thereof is supported above and in spaced relationship to a face of a shoulder region of the stator, preferably via a washer of plastic or the like which has been installed on a neck portion of the stator. The rotor is axially secured to the stator by means of at least one pin which tangentially engages a circumferential groove in the neck portion of the stator, the pin being received in a cross bore in the rotor.

BRIEF DESCRIPTION OF THE DRAWING

The invention is explained in more detail below with reference to the exemplary embodiment illustrated in the enclosed drawing wherein like reference numerals refer to like elements in the several FIGURES and in which.

DESCRIPTION OF THE DISCLOSED EMBODIMENT

Figure 1:
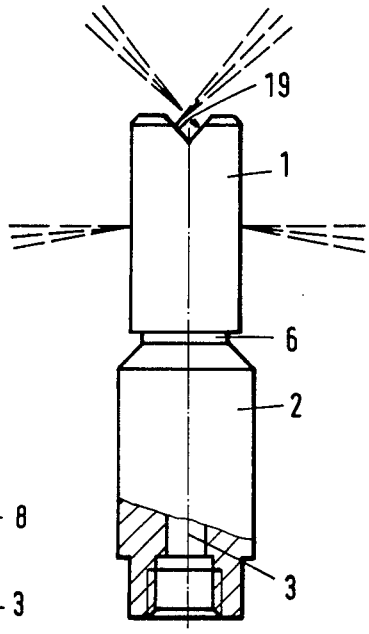
FIG. 1 is a side elevation view, partly in section, of a swirl jet nozzle in accordance with a first embodiment of the present invention.

The swirl jet nozzle illustrated in FIG. 1 comprises a tubular rotor 1 which is designed to discharge fluid jets from its forward face. Rotor 1 is arranged on a stator 2. The stator 2 is provided with a central bore 3 via which the delivery of the pressurized working fluid to the rotor is effected. The rotor 1 has on its face a V-groove 19 into which outlet orifices of nozzle inserts 18 open. The inserts 18 define crossing jets which reliably achieve the dislodging of resistant deposits from the wall of a pipe. The intersection of the jets emerging from the side surfaces of the V-shaped groove 19 lies preferably in the region of the face of the rotor 1 or beyond and ahead of it.

Figure 4:
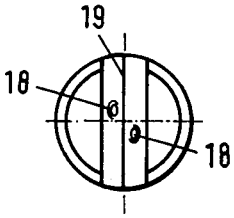
FIG. 4 is a plan view of the end of the rotor of the swirl jet nozzle of FIG. 1.
Figure 6:
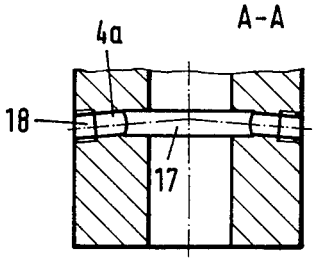
FIGS. 6 to 8 show longitudinal sections of the rotor of the swirl jet nozzle respectively taken along lines AA, BB and CC of FIG. 5.

As can be seen from FIG. 4, the nozzle inserts 18 are arranged off-center, so that forces are developed which will impart rotary motion to the rotor 1 relative to the stator 2. Furthermore, when the tool of the present invention is to be used for cleaning the inside wall of pipes, the rotor 1 can be provided at a point along its length with further nozzle inserts 18 from which auxiliary jets will be discharged in a generally radial direction (see FIGS. 5 and 6). The auxiliary jets are expediently arranged in such a way that they also provide a force which produces rotational motion of the rotor 1 with respect to the stator 2. If need be, the tool can be operated with one of the nozzle groups or with a single nozzle. In the latter case, the remaining nozzle inserts 18 can be replaced by closure plugs, which are screwed into the corresponding outlet ports.

Figure 2:
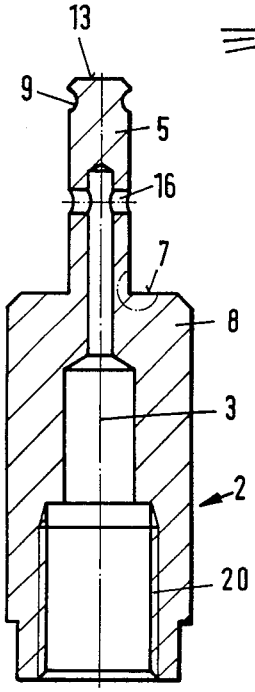
FIGS. 2 and 3 show, on an enlarged scale, a longitudinal section through the stator and rotor, respectively, of the swirl jet nozzle of FIG. 1.
Figure 3:
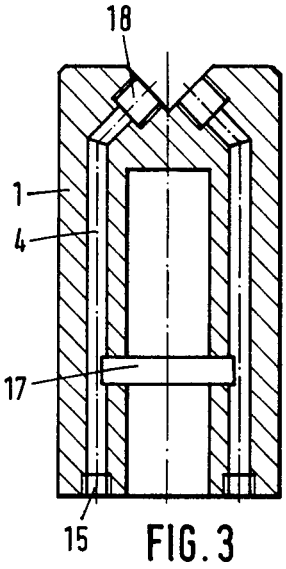
Figure 5:
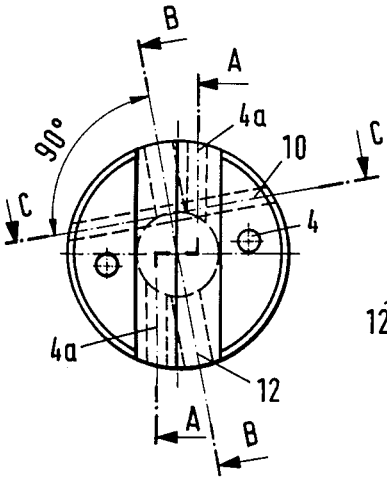
FIG. 5 is a schematic illustration which depicts the various fluid flow passages in a rotor of a swirl jet nozzle in accordance with the present invention.
Figure 7:
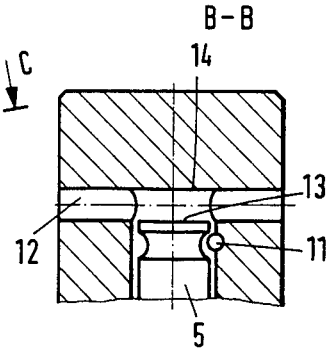
Figure 8:
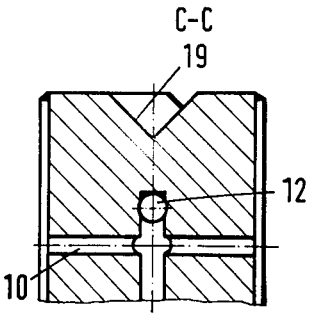

The stator 2 has at its rear end, i.e., at the lower end as the apparatus is shown in FIGS. 1 and 2, an internally threaded connector 20 for receiving a hose extending from a source of high-pressure liquid. The cylindrical housing of the stator 2 is flattened in the region of the connection 20 so that it may be engaged by a suitable tool when affixing the high-pressure fluid supply hose thereto. Cross bores 16 extend from axial bore 3 to the gap between rotor 1 and stator 2 and are located ahead of an annular space 17 provided inside the rotor 1. Flow passages 4 formed in rotor 1 extend between annular space 17, which is in the form of an interior groove, and the nozzle inserts 18 in the V-groove 19. Flow passages 4 also extend, in the opposite direction, to discharge ports 15 which are directed towards a flat face 7 defined by a shoulder at the junction between a smaller diameter neck portion 5 and the larger diameter base portion 8 of the stator 2. In the preferred embodiment, a washer 6 of plastic or the like is located between the stator and rotor on face 7. Further flow passages 4a will, as may be seen from FIGS. 5 and 6, extend from annular space 17 to further nozzle inserts 18, which discharge in a generally radial direction relative to the axis of the rotor 1. As may be seen from FIG. 5, the axes of the pressure medium outlet ports extend, as represented by line AA, parallel to the radius of the rotor 1, but are laterally offset with respect thereto. Referring to FIG. 2, a circumferential groove 9 is provided on the neck or reduced diameter portion 5 of the stator 2 which extends into the rotor 1. Referring jointly to FIGS. 5, 7 and 8, a pin 11 axially secures the rotor 1 on the stator 2, pin 11 being received in a cross-bore 10. As FIGS. 5, 7 and 8 show, the rotor 1 is also provided with a pressure relief orifice 12 in its base portion 14. Orifice 12 prevents pressure from building up ahead of the face of the neck 5 which could lead to a rupture of the pin 11 in the cross bore 10.

The flow passages 4, which extend in opposite directions from annular groove 17, are expediently designed as linear conduits which extend longitudinally through the rotor 1.

Rotor 1 and stator 2 are designed as generally cylindrical bodies, the stator 2 in some cases having a larger maximum diameter than the rotor 1. It is desirable that the startor have a larger diameter than the rotor if, for example, the stator 2 serves as a guide when the tool is employed for the cleaning of narrow pipes. The rotor 1 can be given a hardened jacket of steel since, when the invention is used as a drilling tool in completely clogged pipes, the rotor otherwise wears too quickly. The core of the rotor 1 is preferably made of bronze so that it does not seize on the stator 2 when the supply of pressurized liquid is switched off.

The stator 2 can in some cases also be fitted in a known way with recoil nozzles, so that the tool can advance automatically, i.e., be self-propelled, through a line or through a bore. The stator 2 can also be provided with or structurally united with a thrust piece having obliquely rearward directed nozzles which are in communication with the central pressurized water supply bore 3.

All nozzle inserts 18 are inserted, in particular screwed, into the pressure medium outlet ports in such a way that they do not protrude beyond the outer contours of the rotor 1 and thus impact damage to the inserts 18 is impossible. The nozzle defining inserts 18 preferably have, about their circumferenece, an outer thread which in some cases is adhesively bonded to the rotor 1. The nozzle inserts also preferably have, on their discharge jet outlet side, a quadrant or a hexagon. Rectifiers, in the form of crossing plates, can be inserted ahead of each nozzle insert. When using a swirl jet nozzle in accordance with the invention and having front and radial dischargers, the nozzles can be designed in such a way that the torque developed as a result of the discharges from the generally radially directed nozzles is opposed to the torque developed by operation of the front or cutting nozzles and, moreover, is larger, so that the front nozzles are forced to rotate in a direction which is opposed to their torque. This increases the cleaning effect considerably.

In the operation of the swirl jet nozzle of the present invention, the pin 11, which positively engages the circumferential groove 9 in the neck 5 of stator 2, slides in circumferential groove 9. Due to the pressure of the operating fluid discharging from orifices 15 in the direction of the washer 6, the latter is pressed firmly against the stator 2 and does not itself rotate. A liquid mist or film is developed between all rotating parts and facing, i.e., cooperating adjacent, fixed parts to effect a floating bearing of the rotor on the stator. While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Apparatus for producing a swirling jet of pressurized liquid for use in the removal of solid material from an adjacent surface comprising:

a stator including a body with a first portion having a first cross-sectional area at a first end thereof, said body also including a neck portion extending from said first end of said first portion, said neck portion having a longitudinal axis and an average cross-sectional area which is smaller than said first cross-sectional area, at least a part of the first end of said first portion of said body which is contiguous to said neck portion defining a reaction surface, said stator being adapted for coupling at a second end of said body first portion which is disposed oppositely with respect to said first end to a source of pressurized liquid, said body in part defining a supply conduit for said liquid which extends through said first portion and into said neck portion, said supply conduit terminating at a discharge port in said neck portion oriented transversely to said axis, said stator neck portion further having a circumferential groove in the exterior thereof;

a rotor having an elongated internal cavity sized and shaped to receive said stator neck portion, said rotor being coaxial with said stator neck portion and having oppositely disposed first and second ends, said rotor having at least a first jet defining discharge port in the first end thereof, said discharge port having an axis which is angularly oriented with respect to said stator neck portion axis, said rotor having at least a first flow passage for the pressurized liquid which extends between an inner surface thereof which faces the stator neck portion and said first jet defining discharge port whereby pressurized fluid discharged through said discharge port in said stator neck portion will be delivered to said rotor first jet defining discharge port, said rotor further defining a second flow passage for said pressurized liquid between said inner surface thereof and the second end thereof, said rotor second end having a surface which is disposed oppositely to and in facing relationship to said stator reaction surface, said rotor first end including a face portion which defines a plane oriented substantially transversely with respect to the stator neck portion axis, and said face portion having a generally V-shaped groove formed therein, said first jet defining discharge port being located in a side wall of said generally V-shaped groove; and a retainer captured in said rotor, said retainer including a pin which extends linerarly across a portion of the internal cavity in said rotor, said pin intercepting said circumferential groove in said stator neck portion to capture said rotor on said stator while permitting relative rotation therebetween.

2. The apparatus of claim 1 wherein said rotor means first flow passage includes at least two flow paths extending between said inner surface thereof and said face portion, said flow paths terminating at first ends thereof in jet defining discharge ports located in opposite sides of said generally V-shaped groove, said flow passages terminating at the opposite ends thereof at an annular groove in the wall which defines said internal cavity.

3. The apparatus of claim 2 wherein said rotor further comprises at least one pressure relief orifice which extends beteen said external cavity in the vicinity of the stator neck portion and the exterior of said rotor.

4. The apparatus of claim 2 wherein said stator defined supply conduit comprises a bore which is coaxial with said neck portion axis and a plurality of cross-bores which extend partly through said neck portion and intercept said coaxial bore and wherein said stator neck portion and said rotor internal cavity cooperate to define an annular space with which said cross-bores communicate.

5. The apparatus of claim 4 wherein said reaction surface has an annular shape and lies in a plane which is transverse to said stator neck portion axis and wherein said rotor second end defines a planar annular surface interrupted by a discharge port which communicates with said second flow passage.

6. The apparatus of claim 5 wherein said rotor has a generally cylindrical shape and is provided with at least a pair of further discharge ports in the side wall thereof, said further discharge ports being in fluid communication with said internal cavity and discharging in a direction generally parallel to and offset with respect to the radii of said rotor, the flow of fluid through said further discharge ports resulting in the generation of torque which imparts rotational motion to said rotor.

7. The apparatus of claim 6 wherein said further discharge ports each have an axis and wherein said further discharge port axes are linear and are generally parallel to and offset with respect to radii of said rotor.

8. The apparatus of claim 7 wherein said rotor second flow passage includes at least two flow paths extending between said rotor inner surface and equally spaced apart discharge ports in said second end defined annular surface.

9. A swirl jet nozzle for use as a hydraulic work tool comprising:

a stator body having a longitudinal axis, a first end of said stator body defining a support surface and a second end of said stator body being adapted for coupling to a source of pressurized liquid, said support surface having an annular shape and lying in a plane which is transverse to said longitudinal axis;

a stator neck portion of reduced diameter relative to said stator body, said neck portion coaxially extending from said support surface along said longitudinal axis, said stator neck portion being provided with a circumferential groove in the exterior thereof;

a first flow passage for the pressurized liquid, said first flow passage extending coaxially through said stator body and into said stator neck portion, said neck portion having at least one discharge opening which provides fluid communication between said first flow passage and the exterior of the said neck portion at the side thereof;

a sleeve-like rotor having first and second ends and being shaped to define an internal cavity which coaxially receives said stator neck portion with clearance whereby a generally annular chamber is defined between said rotor and said stator neck portion, said rotor first end facing said stator body support surface, said discharge opening in said stator neck portion communicating with said annular chamber, said clearance being sufficient to permit said rotor to rotate freely relative to said stator neck portion, said rotor further including at least two flow paths extending between said cavity and equally spaced apart discharge ports in said first end;

a pin extending across a portion of said rotor internal cavity, said pin intercepting said circumferential groove in said stator neck portion to capture said rotor on said neck portion while permitting said relative rotation therebetween, said rotor being retained axially on said stator neck portion by said pin;

at least one jet-defining discharge port formed in said rotor, said jet-defining discharge port being located in said rotor second end and being oriented so that pressurized liquid discharged therefrom imparts rotational force to said rotor whereby said discharged liquid defines a swirling jet; and an additional flow passage in said rotor, said additional flow passage extending between said jet-defining discharge port and said rotor internal cavity whereby pressurized liquid from said first flow passage will be delivered to said jet-defining discharge port via said additional flow passage and said internal cavity.

* * * * *